US006488171B1

(12) United States Patent
Diveley

(10) Patent No.: US 6,488,171 B1
(45) Date of Patent: Dec. 3, 2002

(54) CONTAINER FOR VISCOUS FLUIDS

(76) Inventor: Steven A. Diveley, 1127 Wilkin Rd., Danville, IL (US) 61832

( * ) Notice: Subject to any disclaimer, the term of this patent is extended or adjusted under 35 U.S.C. 154(b) by 0 days.

(21) Appl. No.: 10/038,831

(22) Filed: Dec. 31, 2001

Related U.S. Application Data

(60) Provisional application No. 60/265,140, filed on Jan. 30, 2001.

(51) Int. Cl.[7] ..... B65D 1/00

(52) U.S. Cl. ..... 220/571; 220/601; 220/631

(58) Field of Search ..... 220/571, 4.04, 220/601, 631

(56) References Cited

U.S. PATENT DOCUMENTS

| | | | | | |
|---|---|---|---|---|---|
| 1,851,073 | A | | 3/1932 | Wachsman | |
| 3,097,757 | A | | 7/1963 | Searer | 215/11 |
| 3,250,434 | A | * | 5/1966 | Howlett | 222/143 |
| 4,013,105 | A | * | 3/1977 | Uuskallio | 220/571 X |
| 4,127,206 | A | * | 11/1978 | Virog, Jr. et al. | 215/1 C |
| 4,722,850 | A | | 2/1988 | White et al. | 426/111 |
| 4,781,314 | A | * | 11/1988 | Schoonover et al. | 222/465.1 |
| 4,928,860 | A | * | 5/1990 | Knight | 220/631 X |
| 5,071,028 | A | * | 12/1991 | Murphy | 220/601 |
| D367,229 | S | | 2/1996 | Hartman | D9/526 |
| 5,794,904 | A | | 8/1998 | Hackley | 248/311.3 |

* cited by examiner

*Primary Examiner*—Steven Pollard
(74) *Attorney, Agent, or Firm*—Philip L. Bateman

(57) ABSTRACT

A container having an enclosure and a lid is used for storing viscous fluids. The enclosure has a first flat face and a second flat face. The enclosure is stable when resting on either the first or second face. The enclosure has an interior wall along the second face that slopes downwardly from the first face to a third face to define a lowermost region at the intersection of the second face and the third face when the container rests on its second face. The enclosure also has an open neck at the intersection of the second face and the third face that extends parallel to the second face and upon which the lid is secured. When the container rests on the second face, the contents of the container drain into the neck. When the container rests on the first face, the contents of the container drain away from the neck.

14 Claims, 3 Drawing Sheets

Fig. 5
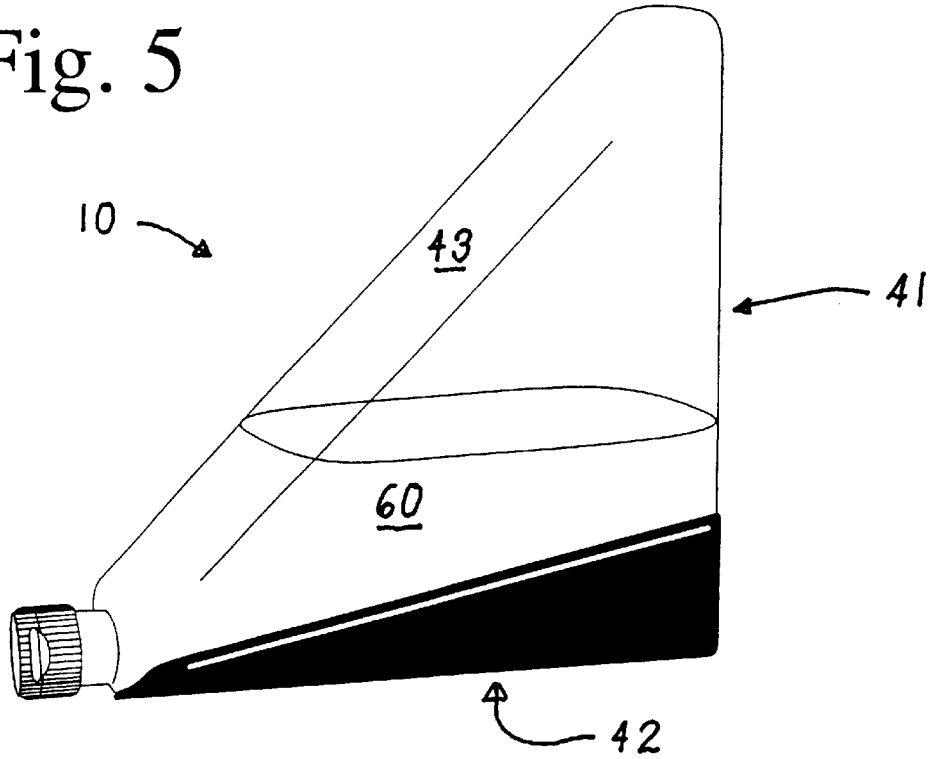
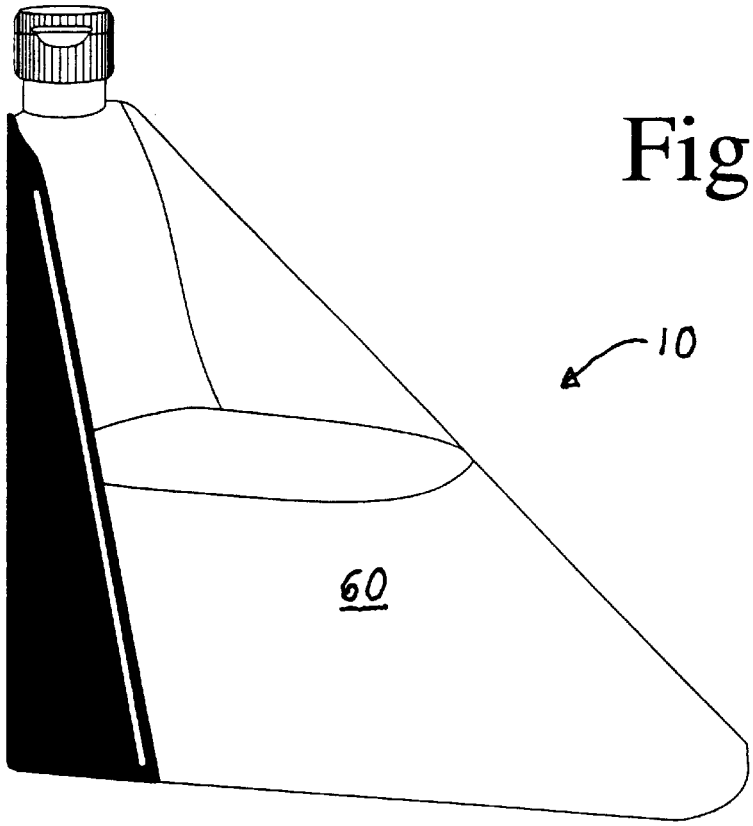
Fig. 6

CONTAINER FOR VISCOUS FLUIDS

CROSS-REFERENCE TO RELATED APPLICATION

This application claims the benefit of U.S. Provisional Application Serial No. 60/265,140, filed Jan. 30, 2001.

FIELD OF THE INVENTION

This invention relates to containers for viscous fluids.

BACKGROUND OF THE INVENTION

A variety of foods, cosmetics, adhesives, and the like are sold in the form of a viscous fluid. Some of the more common foods sold as viscous fluids include ketchup, salad dressings, and sauces. Common cosmetics sold as viscous fluids include shampoos, creams, and lotions. These viscous fluid products are typically sold in relatively tall and thin containers having an opening and a lid at the top. When such a container is relatively full, it is desirable to store it in an upright position (with the opening and lid at the top) for two reasons. First, this position ensures that the product in the container does not drain out if the lid does not seal. Second, this position ensures that a large quantity of the product does not immediately pour out when the lid is removed and the container is turned over. However, when the container is nearly empty, these two reasons become less a factor and the problem of waiting for the product to flow out becomes more important. As the contents of the container decrease, it takes longer for the contents to flow through the container to the opening. As a result, it takes longer for the product is flow out when the container is turned over. Containers are frequently discarded when significant amounts of product remain simply because the time required for the product to flow out becomes unacceptable. Accordingly, there is a demand for a container for viscous fluids that can be stored stably in two positions, one of which is used when the container is full and one of which is used when the container is nearly empty.

Containers that have two storage positions are disclosed in Wachsman, U.S. Pat. No. 1,851,073, issued Mar. 29, 1932; Searer, U.S. Pat. No. 3,097,757, issued Jul. 16, 1963; White et al., U.S. Pat. No. 4,722,850, issued Feb. 2, 1988; Hartman, U.S. Pat. No. Des. 367,229, issued Feb. 20, 1996; and Hackley, U.S. Pat. No. 5,794,904, issued Aug. 18, 1998. Other containers have relatively large caps and can be stored either with the cap pointing up or down. However, none of these containers has a position resting on a first face in which the contents are drained away from the opening, a second position resting on an adjacent face in which the contents are drained to the opening, and are stable in both positions.

SUMMARY OF THE INVENTION

The general object of this invention is to provide an improved container for viscous fluids. A more particular object is to provide a container that can be stored stably in one of two positions—a first position when the container is full and a second position when the container is nearly empty. Another more particular object is to provide a container that enables viscous fluids to be poured out more quickly when nearly empty.

I have invented an improved container for viscous fluids. The container comprises: (a) an enclosure having a first face, a second face, and a third face; the second face separating and communicating with the first and the third faces; the first and second faces being substantially flat and having sufficiently large surface areas that the enclosure is stable when resting on either face; the enclosure having an interior wall along the second face that slopes downwardly from the first face to the third face to define a lowermost region at the intersection of the second face and the third face when the container rests on its second face; the enclosure further having an open neck at the intersection of the second face and the third face that extends parallel to the second face; and (b) a lid that fits over the open neck. When the container rests on the first face, the contents of the container drain away from the neck and when the container rests on the second face, the contents of the container drain into the neck.

The container of this invention can be stored in either of two positions. When the container is full, the container is stored resting on it first face with the contents of the container drained away from the neck. When the container is nearly empty, the container is stored resting on its second face with the contents drained toward the neck. This, in turn, enables the contents to be poured out quickly.

BRIEF DESCRIPTION OF THE DRAWINGS

FIG. 5 is a perspective view of a third embodiment of the container shown holding a quantity of fluid.

FIG. 6 is a perspective view thereof shown in a second position.

DETAILED DESCRIPTION OF THE INVENTION

Figure 1:
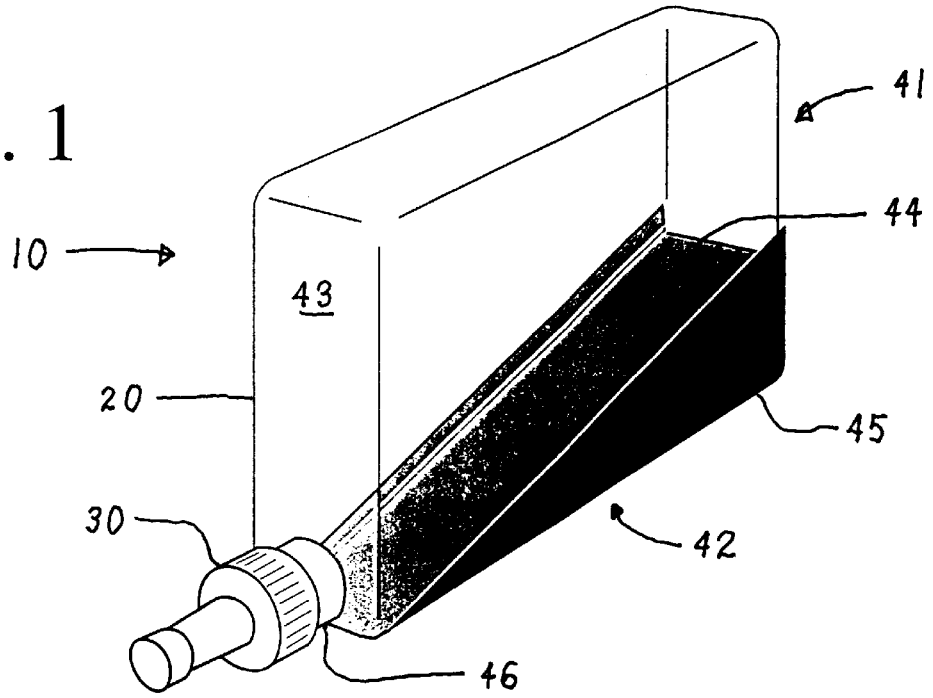
FIG. 1 is a perspective view of a first embodiment of the container of this invention.
Figure 2:
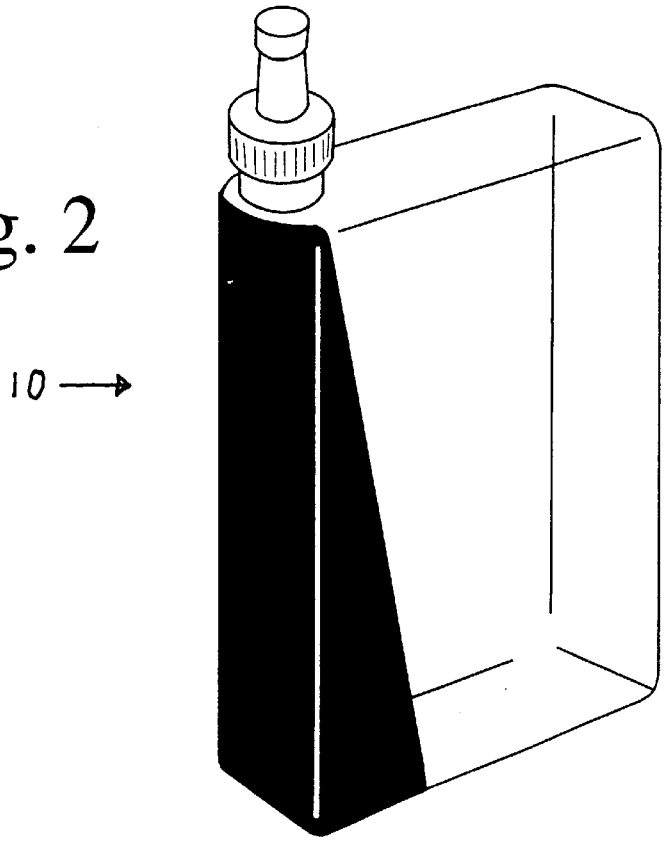
FIG. 2 is perspective view thereof shown in a second position.
Figure 3:
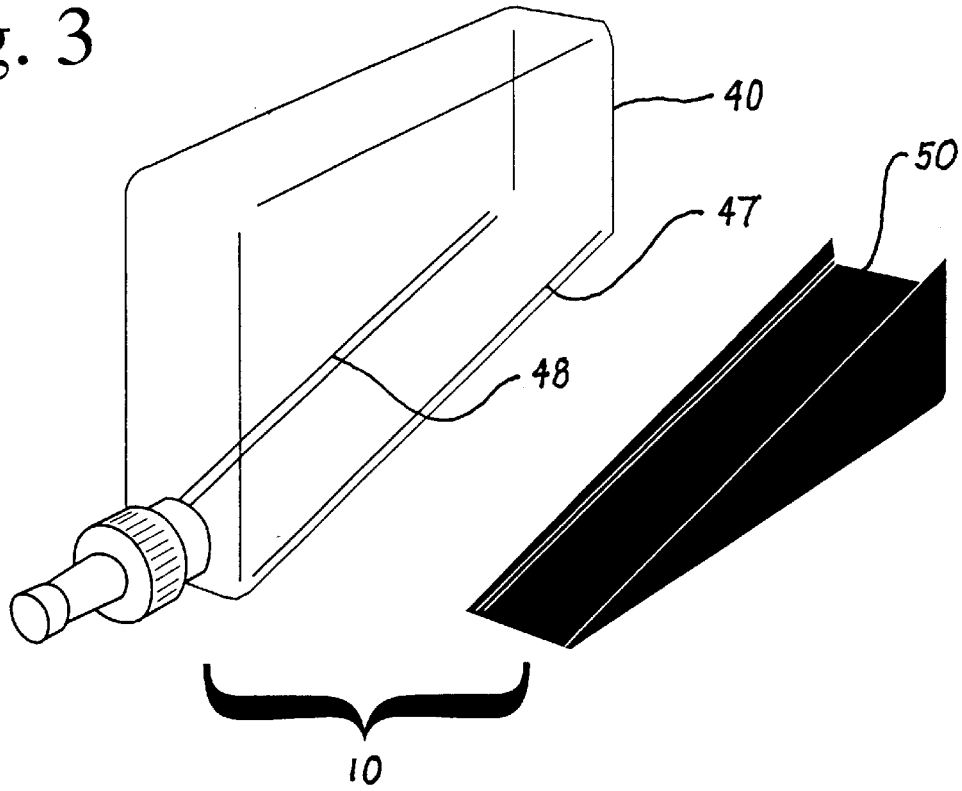
FIG. 3 is a partially-exploded perspective view of a second embodiment of the container of this invention.

This invention is best understood by reference to the drawings. A first embodiment of the container 10 of this invention is shown in FIGS. 1 and 2. This embodiment comprises an enclosure 20 and a lid 30. The enclosure has the general shape of a rectangular prism. The enclosure has a first flat face 41, a second flat face 42, and a third face 43. The second face separates and communicates with the first face and the third face.

The interior wall 44 along the second face slopes downwardly (when the second face is horizontal) from the first face to the third face to form an integral wedge 45. Thus, the interior wall and the exterior wall of the second face are not parallel. The angle of the slope is generally about 5 to 45 degrees and preferably about 10 to 30 degrees. As the slope increases, the interior volume decreases for a given exterior volume. The enclosure may be molded as a single piece. Alternatively, the enclosure may be molded as two separate pieces that are then attached together by adhesive or the like. In either case, the wedge is preferably hollow to reduce weight and the cost of material.

The enclosure is stable in two positions—resting on its first face and resting on its second face. The term "stable" is used herein to mean the enclosure can be bumped or tipped slightly in either position and still return to its resting position without tipping over, and that the center of gravity of the enclosure is located at or below the mid-point of its height in either position. The enclosure is stable regardless of the amount of fluid in it. The stability of the enclosure results from several factors, including the flatness of the first and second faces, the relatively large surface areas of the first and second faces, and the weight distribution provided by the wedge. This embodiment of the bottle takes up less shelf or counter space when resting on its first face than when resting on its second face. In other words, the bottle has different "footprints" in the two positions.

The enclosure contains a neck 46 that extends parallel to the second face from a point near the intersection of the second face and the third face. The neck contains external threads which mate with internal threads of the lid. It can be seen that, when the container rests on the second face, the contents of the container drain into the neck and, when the container rests on the first face, the contents of the container drain away from the neck. The lid is conventional and various types of lids are suitable. One-piece lids or flip-top lids are used equally advantageously.

The size of the enclosure is a matter of choice. For most foods and cosmetics, the enclosure has a volume of about five to fifty fluid ounces (about nine to ninety cubic inches). To fit easily on standard shelves and counters, the enclosure preferably has a height (the length along either its first or second faces) of less than about ten inches. In the first embodiment where the enclosure has the shape of a rectangular prism and where there is no handle, the width of the enclosure is preferably about one to six inches. If the width is less than about one inch, the volume of the enclosure becomes prohibitively low and the enclosure is prone to tipping on its side. If the width is greater than about six inches, the enclosure becomes difficult to hold without a handle. For commercial and industrial use, the size of the enclosure can be many times larger.

The enclosure is made of a durable material that can be easily produced in the desired shape. The material can be transparent, translucent, or opaque as desired. Suitable materials include thermoplastics, glass, metals, and the like. The preferred materials for the enclosure are resilient thermoplastics such as high density polyethylene and high density polypropylene. These thermoplastics are inexpensive, easily molded, safe for use with food products, and are impervious to a wide variety of materials. They can also be translucent or opaque, clear or colored.

When full, the container of this invention is used in much the same manner as conventional containers. It is stored on its first face, as shown in FIG. 2, and takes up approximately the same amount of space as a conventional container having the same capacity. However, the container of this invention becomes especially useful when most of the viscous fluid has been used and only a small amount remains in the container. When this happens, the container is stored on its second face, as shown in FIG. 1. The viscous fluid in the container drains down into the lowermost region at the intersection of the second face and the third face. The fluid is restrained by the lid and fills the neck portion of the enclosure. When the fluid product is needed, the lid is opened and the contents pour out immediately. There is no need to wait long periods of time for fluid to flow from one end of the container to the other.

Figure 4:
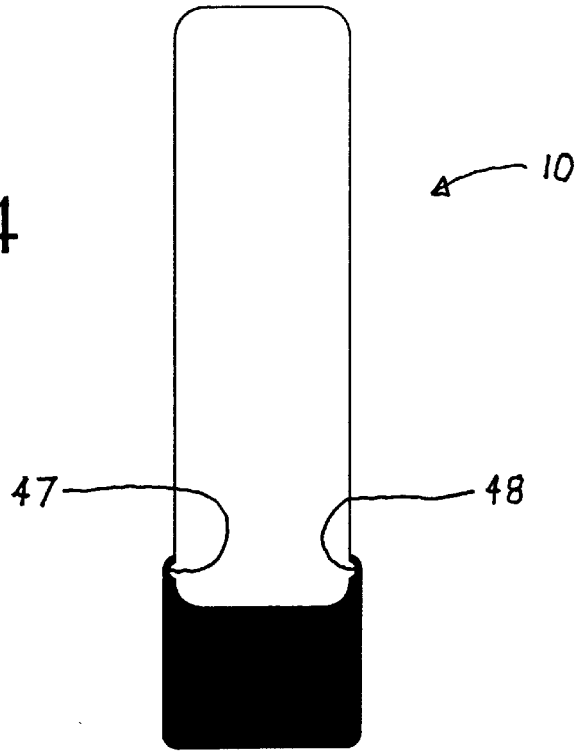
FIG. 4 is a rear elevation view thereof.

A second embodiment of the container is shown in FIGS. 4 and 5. This embodiment is similar to the first embodiment except that the enclosure is made of two separate parts, a bottle 40 and a bracket 50, that are removably attached together. In the embodiment shown, the bottle contains gripping ridges 47 and 48 on the sides along the second face. These ridges fit within mating grooves on the inside of the bracket. The ridges and mating grooves provide a secure connection that is easy to make and to undo. A wide variety of other removable attaching means are suitable.

A third embodiment of the container is shown holding a quantity of a viscous fluid 60 in FIGS. 5 and 6. The enclosure of this embodiment has the general shape of a triangular prism. When viewed from a side, the enclosure has a shape of a right triangle with a hypotenuse face 43 opposite the right angle and with a first flat face 41 and a second flat face 42. When viewed from the front or from the back, the embodiment of the enclosure has a generally rectangular shape. However, other shapes when viewed from the front and back are suitable. For example, an alternate shape for the front and back faces of the enclosure is pyramidal with the second face (the base of the pyramid) being either triangular or square. This embodiment of the bottle takes up substantially the same amount of shelf or counter space when resting on its first or second faces. In other words, the bottle has substantially the same "footprint" in either position.

Various other embodiments of the container are also suitable. For example, other container shapes include prisms in which the first and third faces are squares, pentagons, or other polygons. Another container shape is a cylinder truncated along its length. This shape can also be described as a prism in which the first and third faces are domes having a single flat side.

I claim:

1. A container for viscous fluids, the container comprising:

(a) an enclosure having a first face, a second face, and a third face; the second face separating and communicating with the first and the third faces; the first and second faces being substantially flat and having sufficiently large surface areas that the enclosure is stable when resting on either face; the enclosure having an interior wall along the second face that slopes downwardly from the first face to the third face to define a lowermost region at the intersection of the second face and the third face when the container rests on its second face; the enclosure further having an open neck at the intersection of the second face and the third face that extends parallel to the second face; and (b) a lid that fits over the open neck; such that, when the container rests on the first face, the contents of the container drain away from the neck and such that, when the container rests on the second face, the contents of the container drain into the neck.

2. The container of claim 1 wherein the enclosure comprises a bottle and a wedge-shaped bracket that is attached to the bottle at the interior wall along the second face.

3. The container of claim 2 wherein the bottle and wedge-shaped bracket are removably attached.

4. The container of claim 3 wherein the first face and second face intersect at substantially a right angle.

5. The container of claim 4 wherein the first face and second face are rectangular.

6. A container for viscous fluids, the container comprising:

(a) an enclosure having a first flat face and a second flat face; the first face and the second face having substantially the same dimensions; the enclosure being stable when resting on either the first or second face; the enclosure having an interior wall along the second face that slopes downwardly from the first face to a third face to define a lowermost region at the intersection of the second face and the third face when the container rests on its second face; the enclosure further having an open neck at the intersection of the second face and the third face that extends parallel to the first face; and (b) a lid that fits over the open neck; such that when the container rests on the second face, the contents of the container drain into the neck and such that, when the container rests on the first face, the contents of the container drain away from the neck.

7. The container of claim 6 wherein the enclosure comprises a bottle and a wedge-shaped bracket that is attached to the bottle at the interior wall along the second face.

8. The container of claim 7 wherein the bottle and wedge-shaped bracket are removably attached.

9. The container of claim 8 wherein the first face and second face intersect at substantially a right angle.

10. The container of claim 9 wherein the first face and second face are rectangular.

11. A container for viscous fluids, the container comprising:

(a) an enclosure having a shape, when viewed from a side, of a right triangle with a hypotenuse face, a first face, and a second face; the enclosure being stable when resting on either the first or second face; the enclosure having an interior wall along the second face that slopes downward from the first face to the hypotenuse face to define a lowermost region at the intersection of the second face and hypotenuse face when the container rests on its second face; the enclosure further having an open neck at the intersection of the second face and the hypotenuse face that extends parallel to the second face; and (b) a lid that fits over the open neck; such that when the container rests on the second face, the contents of the container drain into the neck and such that, when the container rests on the first face, the contents of the container drain away from the neck.

12. The container of claim 11 wherein the enclosure comprises a bottle and a wedge-shaped bracket that is attached to the bottle at the interior wall along the second face.

13. The container of claim 12 wherein the bottle and wedge-shaped bracket are removably attached.

14. The container of claim 13 wherein the first face and second face are rectangular.

* * * * *